US011279131B2

(12) United States Patent
Anderson et al.

(10) Patent No.: US 11,279,131 B2
(45) Date of Patent: Mar. 22, 2022

(54) SERVICING BASED ON IMPEDANCE VALUES

(71) Applicant: Hewlett-Packard Development Company, L.P., Spring, TX (US)

(72) Inventors: Daryl E. Anderson, Corvallis, OR (US); Eric Martin, Corvallis, OR (US); James Michael Gardner, Corvallis, OR (US); Jordan Morris, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/763,242

(22) PCT Filed: Dec. 11, 2017

(86) PCT No.: PCT/US2017/065519
§ 371 (c)(1),
(2) Date: May 12, 2020

(87) PCT Pub. No.: WO2019/117846
PCT Pub. Date: Jun. 20, 2019

(65) Prior Publication Data

US 2021/0170749 A1 Jun. 10, 2021

(51) Int. Cl.
*B41J 2/14* (2006.01)
*B41J 2/165* (2006.01)
*B41J 2/175* (2006.01)

(52) U.S. Cl.
CPC ..... *B41J 2/14153* (2013.01); *B41J 2/16579* (2013.01); *B41J 2/175* (2013.01); *B41J 2002/14354* (2013.01)

(58) Field of Classification Search
CPC .... B41J 2/14153; B41J 2/175; B41J 2/16579; B41J 2002/14354
USPC ..... 347/19
See application file for complete search history.

(56) References Cited

U.S. PATENT DOCUMENTS

| | | | |
|---|---|---|---|
| 5,774,136 | A | 6/1998 | Barbehenn et al. |
| 6,557,971 | B1 | 5/2003 | Vega et al. |
| 9,044,936 | B2 | 6/2015 | Van Brocklin et al. |
| 9,056,465 | B2 | 6/2015 | Massen |
| 9,770,909 | B2 | 9/2017 | Chen et al. |

(Continued)

FOREIGN PATENT DOCUMENTS

| | | |
|---|---|---|
| WO | WO-2011146156 | 11/2011 |
| WO | WO-2012054017 A1 | 4/2012 |
| WO | WO-2016175853 A1 | 11/2016 |

OTHER PUBLICATIONS

HP Pagewide Technology, Feb. 17, 2016, http://h20195.www2.hp.com/v2/GetPDF.aspx/4AA6-5003EEAU.pdf.

*Primary Examiner* — Kristal Feggins
*Assistant Examiner* — Alexander D Shenderov
(74) *Attorney, Agent, or Firm* — Fabian VanCott

(57) ABSTRACT

A fluid ejection system may include a fluidic die comprising at least one fluid ejection device, at least one electrical impedance sensor to detect at least one impedance value during a plurality of stages of existence of a drive bubble in at least one firing chamber associated with the at least one fluid ejection device, and a service station wherein, based on the impedance values detected, the printing system services the at least one fluid actuator.

14 Claims, 10 Drawing Sheets

(56) References Cited

U.S. PATENT DOCUMENTS

| | | | | |
|---|---|---|---|---|
| 2002/0063745 | A1* | 5/2002 | Osborne | B41J 2/16579 347/19 |
| 2008/0259114 | A1* | 10/2008 | Tyvoll | B41J 29/17 347/22 |
| 2012/0154483 | A1 | 6/2012 | Kamito et al. | |
| 2013/0278656 | A1* | 10/2013 | Govyadinov | B41J 2/2142 347/9 |
| 2017/0050429 | A1 | 2/2017 | Anderson et al. | |

* cited by examiner

SERVICING BASED ON IMPEDANCE VALUES

BACKGROUND

Printing devices include at least one fluid ejection device formed within a firing chamber of a fluidic die. The fluid ejection device may a resistive heater positioned within the chamber to evaporate a small amount of fluid within the firing chamber. In some examples, one component of the fluid may be water. The resistive heater evaporates the water during firing of the resistive heater. The evaporated fluid component or components expand to form a drive bubble within the firing chamber. This expansion may exceed a restraining force so as to expel a single droplet out of an orifice formed within the fluidic die. After the release of a droplet of fluid, the pressure in the firing chamber drops below the strength of the restraining force within the firing chamber and the remainder of the fluid is retained within the firing chamber. Meanwhile, the drive bubble collapses and fluid from a fluid reservoir may be allowed to flow into the fluid chamber replenishing the lost fluid volume from the droplet release. This process may be repeated each time the fluidic die is instructed to fire.

BRIEF DESCRIPTION OF THE DRAWINGS

The accompanying drawings illustrate various examples of the principles described herein and are part of the specification. The illustrated examples are given merely for illustration, and do not limit the scope of the claims.

Figure 1:
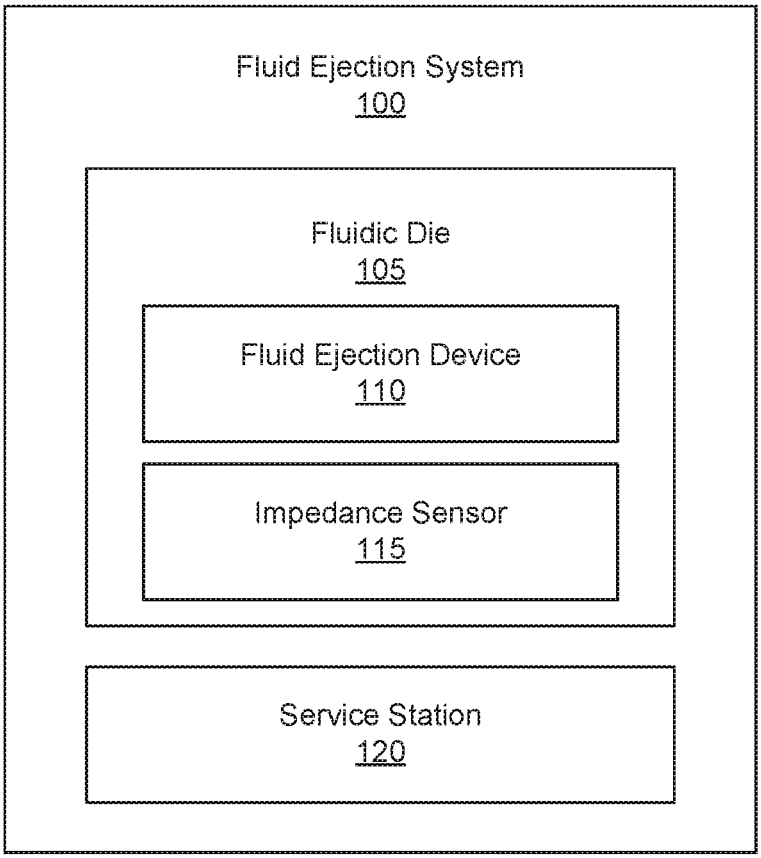
FIG. 1 is a block diagram of a fluid ejection system according to an example of the principles described herein.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION

As mentioned herein, a drive bubble may be formed by a resistive heater placed within a firing chamber of a fluidic die. Certain characteristics of this drive bubble may be detected using, for example, an electrical impedance sensor. The electrical impedance sensor may detect, in an example, the impedance of the fluid and/or air at, at least, one moment during the formation of the drive bubble. In some examples, the electrical impedance sensor may detect the impedance of the fluid and/or air at two different moments in the formation of the drive bubble. A fluid present in the firing chamber may have a different electrically conductive characteristic than air or other gasses present in the drive bubble. In some examples, the fluid may contain partly aqueous vehicle mobile ions. In such examples, when a portion of a surface of the electrical impedance sensor is in contact with the fluid and when a current pulse or voltage pulse is applied to the electrical impedance sensor, the electrical impedance sensor's detected impedance is relatively lower than it would otherwise be without the contact of the fluid.

The electrical impedance sensor may, therefore, be used to make a number of measurements of impedances in order to detect certain characteristics of the drive bubble and/or fluid. The values of the impedances detected provide indications of the state of the fluid within the fluidic die. For example, the detection of these impedance values may indicate to the printing device implementing the fluidic die that a particle had been lodged within the orifice or firing chamber, pigments within the fluid have been separated, that certain components of the fluid have lodged themselves within the particle tolerant architecture of the fluidic die, bubbles are present within the architecture of the fluidic die, a film has formed on top of the resistive heater, puddling of fluid on an outside surface of the orifice of the fluidic die, among other operating defects associated with the fluidic die.

The present specification describes a method of servicing a fluid ejection device that includes detecting at least one impedance values during a plurality of stages of existence of a drive bubble in at least one firing chamber associated with at least one fluid actuator within the fluid ejection device and, based on the impedance values detected, servicing the at least one fluid actuator.

The present specification further describes a fluid ejection device that includes at least one fluid ejection chamber fluidically coupled to at least one fluid actuator that includes a drive bubble formation mechanism; and an electrical impedance sensor positioned to detect a presence of a drive bubble by executing at least one impedance measurement as the drive bubble is formed and collapses and a servicing determination module to, when executed by a processor, service the fluid ejection chamber by activating a microfluidic pump to based, on the impedance values, pump fluid within the at least one fluid ejection chamber.

The present specification also describes a printing system that includes a fluidic die comprising at least one fluid ejection device, at least one electrical impedance sensor to detect at least one impedance value during a plurality of stages of existence of a drive bubble in at least one firing chamber associated with the at least one fluid ejection device, and a service station wherein, based on the impedance values detected, the printing system services the at least one fluid actuator.

FIG. 1 is a block diagram of a fluid ejection system (100) according to an example of the principles described herein. The printing system (100) may include at least one fluidic die (105) that includes at least one fluid ejection device (110). Again, the fluidic die (105) may be formed out of silicon with, at least, the fluid ejection device (110) being formed within a fluidic chamber in the fluidic die (105).

The printing system (100) may further include at least one electrical impedance sensor (115). The electrical impedance sensor (115) detects at least one impedance values during a plurality of stages of existence of a drive bubble in at least one firing chamber associated with the at least one fluid ejection device (110).

The printing system (100), in an example, may further include a service station (120). The service station (120) may be a location within the printing system (100) where the fluidic die (105) is moved over in order to service the fluidic die (105). In some examples, the service station (120) includes a wiper to wipe the fluidic die (105) and a spittoon to receive spitted fluid from the fluidic die (105).

As described herein, the printing system (100) services any number of fluid ejection devices (110) after it has been determined that the impedance values of the fluid from the electrical impedance sensor (115) indicates that servicing is to be initiated.

The printing system (100) may be implemented in or along with any electronic device. Examples of electronic devices include servers, desktop computers, laptop computers, personal digital assistants (PDAs), mobile devices, smartphones, gaming systems, and tablets, among other electronic devices. In an example, the printing system (100) may receive print data from a computing device and execute a print operation based on the print data received. A processor associated with the printing system (100) may execute printing instructions based on the print data in order to form an image with the fluidic die (105) based on the print data.

The printing system (100) may be utilized in any data processing scenario including, stand-alone hardware, mobile applications, through a computing network, or combinations thereof. Further, the printing system (100) may be used in a computing network, a public cloud network, a private cloud network, a hybrid cloud network, other forms of networks, or combinations thereof. In one example, the methods provided by the printing system (100) are provided as a service over a network by, for example, a third party.

To achieve its desired functionality, the printing system (100) may include or be communicatively coupled to a computing device that includes various hardware components. Among these hardware components may be a number of processors, a number of data storage devices, a number of peripheral device adapters, and a number of network adapters. These hardware components may be interconnected through the use of a number of busses and/or network connections. In one example, the processor, data storage device, peripheral device adapters, and a network adapter may be communicatively coupled via a bus.

The processor may include the hardware architecture to retrieve executable code from the data storage device and execute the executable code. The executable code may, when executed by the processor, cause the processor to implement at least the functionality of detecting at least one impedance value during a plurality of stages of existence of a drive bubble in at least one firing chamber associated with at least one fluid actuator within the fluid ejection device, and, based on the impedance values detected, servicing the at least one fluid actuator, according to the methods of the present specification described herein. In the course of executing code, the processor may receive input from and provide output to a number of the remaining hardware units.

The data storage device may store data such as executable program code that is executed by the processor or other processing device. The data storage device may specifically store computer code representing a number of applications that the processor executes to implement at least the functionality described herein. The data storage device may include various types of memory modules, including volatile and nonvolatile memory. For example, the data storage device of the present example includes Random Access Memory (RAM), Read Only Memory (ROM), and Hard Disk Drive (HDD) memory. Many other types of memory may also be utilized, and the present specification contemplates the use of many varying type(s) of memory in the data storage device as may suit a particular application of the principles described herein. In certain examples, different types of memory in the data storage device may be used for different data storage needs. For example, in certain examples the processor may boot from Read Only Memory (ROM), maintain nonvolatile storage in the Hard Disk Drive (HDD) memory, and execute program code stored in Random Access Memory (RAM).

Generally, the data storage device may comprise a computer readable medium, a computer readable storage medium, or a non-transitory computer readable medium, among others. For example, the data storage device may be, but not limited to, an electronic, magnetic, optical, electromagnetic, infrared, or semiconductor system, apparatus, or device, or any suitable combination of the foregoing. More specific examples of the computer readable storage medium may include, for example, the following: an electrical connection having a number of wires, a portable computer diskette, a hard disk, a random-access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a computer readable storage medium may be any tangible medium that can contain, or store computer usable program code for use by or in connection with an instruction execution system, apparatus, or device. In another example, a computer readable storage medium may be any non-transitory medium that can contain, or store a program for use by or in connection with an instruction execution system, apparatus, or device.

The hardware adapters in the printing system (100) enable the processor to interface with various other hardware elements, external and internal to the printing system (100). For example, the peripheral device adapters may provide an interface to input/output devices, such as, for example, display device, a mouse, or a keyboard. The peripheral device adapters may also provide access to other external devices such as an external storage device, a number of network devices such as, for example, servers, switches, and routers, client devices, other types of computing devices, and combinations thereof.

The printing system (100) further comprises a number of modules used in the implementation of the methods and processes described herein. The various modules within the printing system (100) include executable program code that may be executed separately. In these examples, the various modules may be stored as separate computer program products. In another example, the various modules within the printing system (100) may be combined within a number of computer program products; each computer program product comprising a number of the modules.

Figure 2:
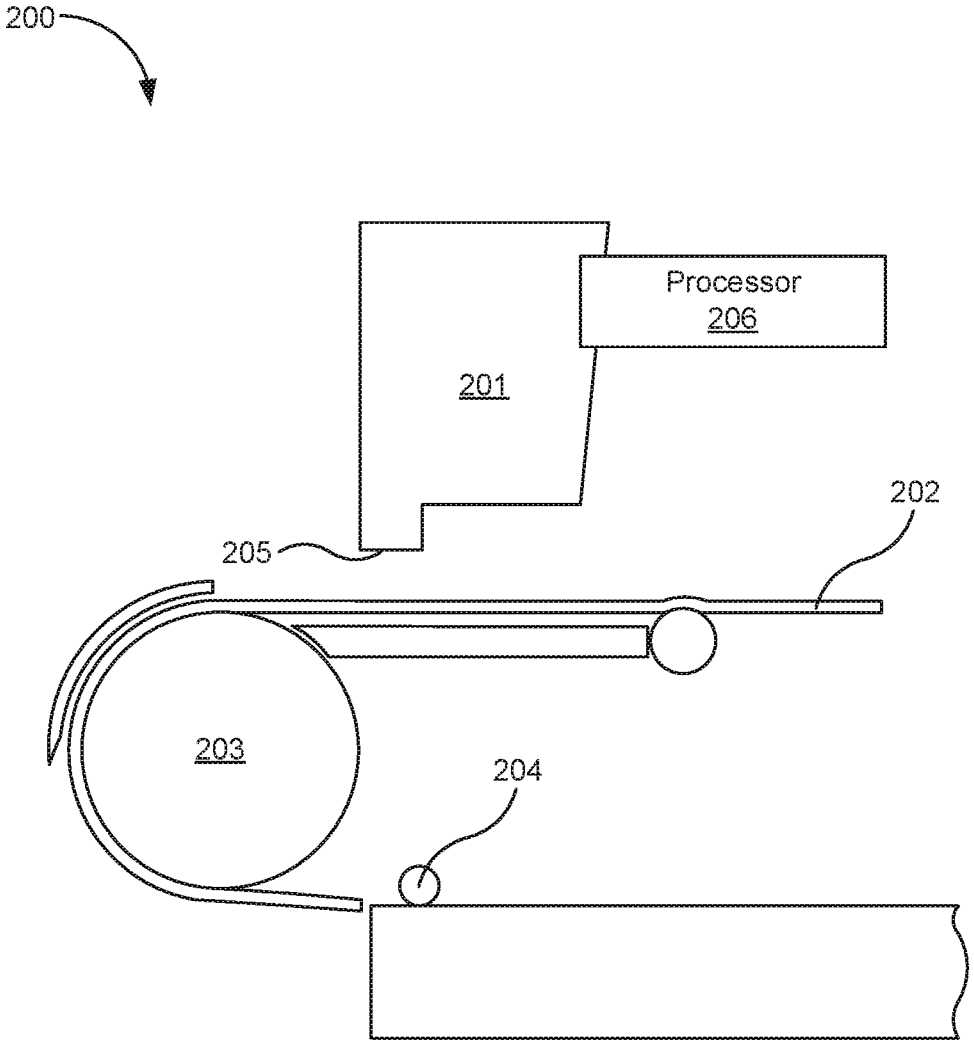
FIG. 2 is a diagram of a printing device according to an example of the principles described herein.

FIG. 2 is a diagram of a printing device (200) according to an example of the principles described herein. In this example, the printing device (200) may include a fluidic cartridge (201) positioned over a printing medium (202) traveling through the printing device (200). The printing device (200) may further include a processor (206) that is in communication with the fluidic cartridge (201) and is programmed to use sensors within the fluidic cartridge (201) to detect the formation and collapse of drive bubbles, as described herein. In an example, the processor (206) also, based on the electrical impedance values from the electrical impedance sensor, detect properties of the fluid within the printhead (201).

The printing medium (202) is pulled from a stack of media individually through the use of rollers (203, 204). In other examples, the printing medium is a continuous sheet or web. The printing medium (202) may be, but is not limited to, paper, cardstock, poster board, vinyl, translucent graphics medium, other printing media, or combinations thereof.

The fluidic cartridge (201) may have a number of orifices formed in a surface of, for example an underside (205) within a fluidic die (FIG. 1, 105). Each orifice may be matched with a fluid ejection device formed within a firing chamber that is in electrical communication with a processor (206). The processor (206) instructs the fluid ejection devices to fire at specific times by receiving a firing signal. The fluid ejection device, in some examples, may be a heating element, resistive heater, a thin-film resistor, other mechanism that may create a bubble within a fluid chamber housing the fluid ejection device. In other examples, a piezo-electric element may create pressure in the fluid chamber to file a desired amount of printing fluid out of a matching orifice.

Although FIG. 1, shows the use of a fluidic cartridge (101), the present specification contemplates the use of the system and method described herein with any type of fluidic device including any type of fluidic die that receives a fluid. In an example, the fluidic die may be used to receive an analyte and conduct analysis on the analyte with or without ejecting the analyte from the fluidic die. The present specification further contemplates the use of the systems and methods described herein with a three-dimensional printing system. In this example, the impedance of the additive build material may be measured and the material ejection device may be serviced based on the characteristics of the build material among other factors.

Figure 3:
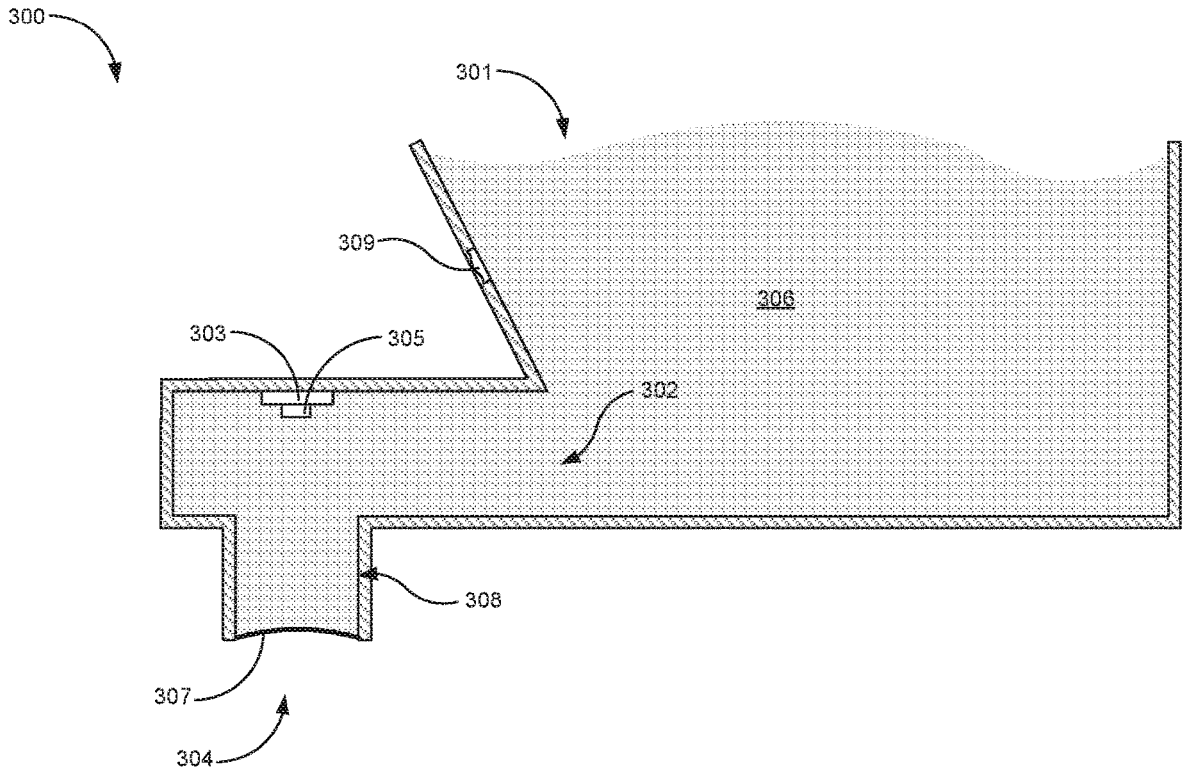
FIG. 3 is a cross sectional diagram of a fluid chamber within the fluidic cartridge of FIG. 2 according to an example of the principles described herein.

FIG. 3 is a cross sectional diagram of a fluid chamber (300) within the fluidic cartridge (201) of FIG. 2 according to an example of the principles described herein. In this example, a fluid chamber (300) is connected to a fluid reservoir (301) through an inlet (302). A heater (303), such as a resistive heater, is positioned over an orifice (304). An electrical impedance sensor (305) is positioned within a fluid chamber (300) and/or within a fluidic channel fluidically coupled to the fluid chamber (300), directly over the heater (303) (i.e., between the heater and the orifice), or near the heater (303). Capillary forces cause the fluid to form a meniscus (307) within a passage (308) of the orifice (304). The meniscus (307) is a barrier between the fluid (306) in the fluid reservoir (301) of the fluid chamber (300) and the atmosphere located below the orifice (304). The internal pressure within the fluid chamber (300) is not sufficient to move fluid out of the fluid chamber (300) unless the fluid chamber's (300) internal pressure is actively increased.

The electrical impedance sensor (305) may have a plate made of a material of a predetermined resistance. In some examples, the plate is made of metal, tantalum, copper, nickel, titanium, or combinations thereof. In some examples, the material is capable of withstanding corrosion due to the material's contact with the fluid (306). A ground element (309) may also be located anywhere within the fluid reservoir (301) of the fluid chamber (300). In the example shown in FIG. 3, the ground element (309) is depicted in the fluid reservoir (301). In some examples, the ground element (309) is an etched portion of a wall with a grounded electrically conductive material exposed. In other examples, the ground element (309) may be a grounded electrical pad. When, in the presence of fluid (306), a voltage or current is applied to the electrical impedance sensor (305), an electrical current or voltage may pass from the electrical impedance sensor (305) to the ground element (309).

The fluid (306) may be relatively more conductive than the air or other gasses in a drive bubble formed by the heater (303) within the fluid reservoir (301). In some examples, the fluid (306) contains partly aqueous vehicle mobile ions. In such examples, when a portion of the electrical impedance sensors (305) surface area is in contact with the fluid (306) and when a current pulse or voltage pulse is applied to the electrical impedance sensor (305), the electrical impedance sensors (305) detectable impedance is relatively lower than it would otherwise be without the fluid's (306) contact. On the other hand, when an increasingly larger amount of the surface area of the electrical impedance sensor (305) is in contact with the gases of a formed drive bubble and a voltage or current of the same strength is applied to the electrical impedance sensor (305), the electrical impedance sensors (305) impedance increases. The electrical impedance sensor (305) may be used to make a measurement of some component of impedance, such as the resistive (real) components at a frequency range determined by the type of voltage source supplying the voltage or current to the electrical impedance sensor (305). In some examples, a cross sectional geometry of the drive bubble or stray bubbles along the electrical path between the electrical impedance sensor (305) and the ground element (309) may also affect the impedance value.

FIGS. 4-7 each show a cross-sectional diagram that depict of the fluid chamber of FIG. 3 during a fluid droplet release according to an example of the principles described herein. Generally, a healthy fluidic die is a fluidic die that is associated with a fluid chamber (300), a heater (303), and other components that are free of defects that would cause the fluidic die to fire improperly. An improperly firing fluidic die includes fluidic dies that fail to fire at all, fires early, fires late, releases too much fluid, releases too little fluid, releases fluid with a relatively too slow of a drop velocity, releases a fluid with a trajectory error, or combinations thereof.

FIGS. 4-7 depict a number of example stages of the drive bubble formation process from its formation to its collapse. Bubble size and geometry are determined by the factors such as an amount of heat generated by the heater (303), the temperature of the fluid, the internal pressure of the fluid chamber (300), the amount of fluid in the fluid reservoir (301), the viscosity of the fluid, the ion concentration of the fluid, the geometry of the fluid chamber (300), volume of the fluid chamber (300), the diameter size of the passage (308), the position of the heater (303), among other factors, or combinations thereof.

Figure 4:
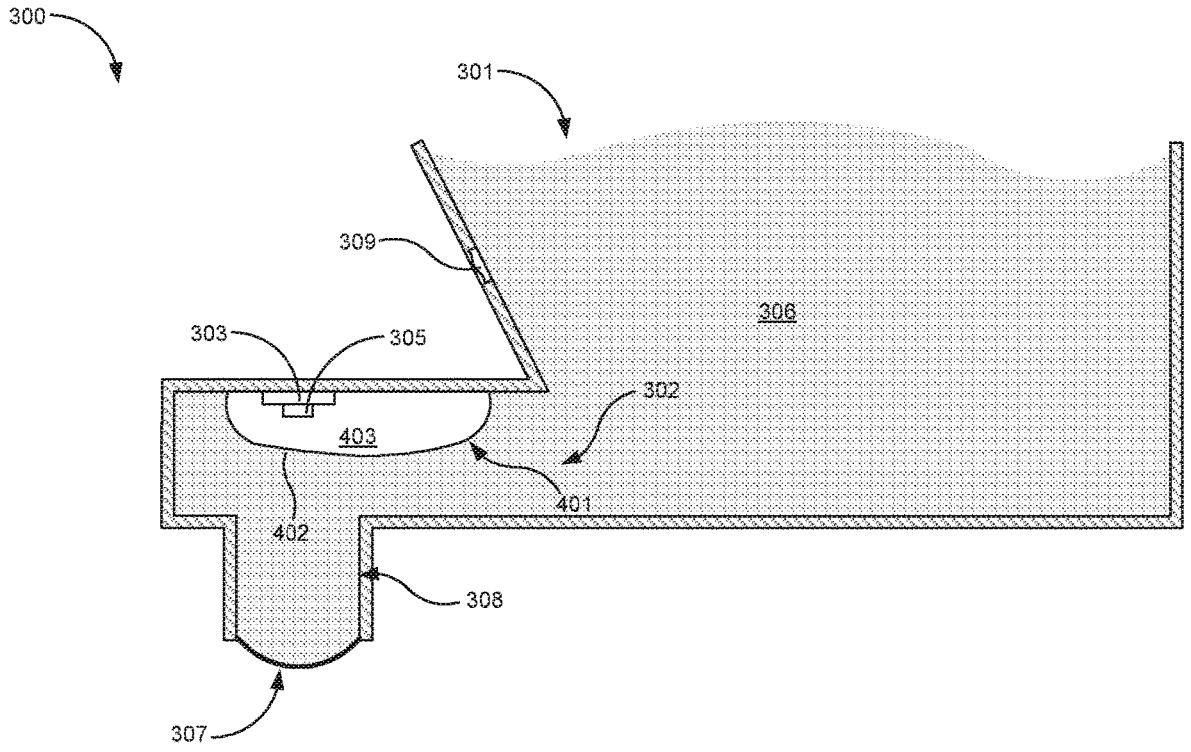
FIG. 4 is a cross-sectional diagram that depicts the fluid chamber of FIG. 3 during a fluid droplet release according to an example of the principles described herein.

FIG. 4 is a cross-sectional diagram that depict of the fluid chamber (300) of FIG. 3 during a fluid droplet release according to an example of the principles described herein.

In FIG. 4, a heater (303) in the fluid chamber (300) is initiating drive bubble formation. A voltage is applied to the heater (303), and the heater's (303) material resists the associated current flow driven by the voltage resulting in Joule heating. This heats the heater's (303) material to a temperature sufficient to evaporate the fluid (306) in contact with the heater (303). As the fluid evaporates, the fluid in gaseous form expands forming a drive bubble (401). A bubble wall (402) separates the bubble's gas (403) from the fluid (306). In FIG. 3, the drive bubble (403) has expanded to such a volume that the heater (303) and the electrical impedance sensor (305) make physical contact just with the bubble's (401) gas (403). Since the electrical impedance sensor (305) is in contact with the bubble's (401) gas (403), the electrical impedance sensor (305) measures an impedance value that indicates the drive bubble (401) is in contact with the electrical impedance sensor (305).

The expansion of the drive bubble (401) increases the internal pressure of the fluid chamber (300). During the stage depicted in FIG. 4, the fluid chamber's (300) internal pressure displaces enough fluid to force the meniscus (307) within the passage (308) to bow outward. However, at this stage, inertia continues to keep all of the fluid (306) together.

Figure 5:
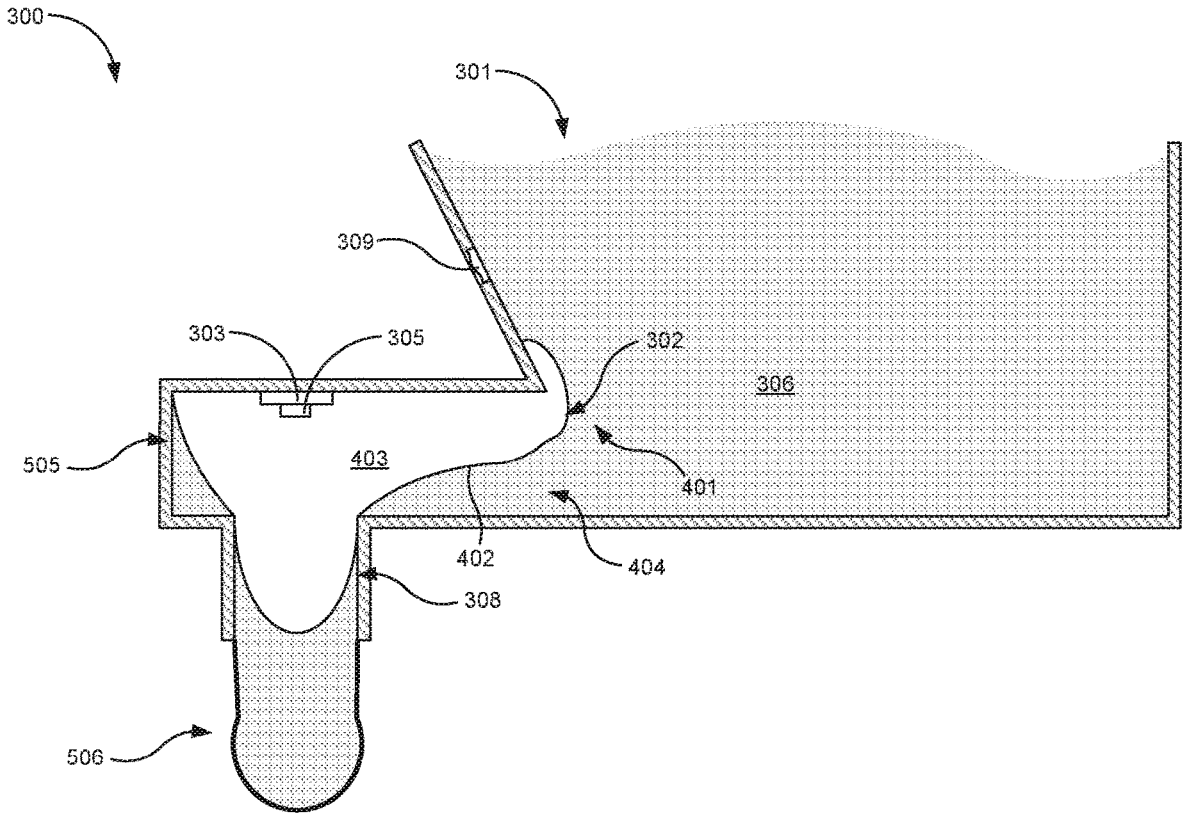
FIG. 5 is a cross-sectional diagram that depicts the fluid chamber of FIG. 3 during a fluid droplet release according to an example of the principles described herein.

FIG. 5 is a cross-sectional diagram that depict of the fluid chamber (300) of FIG. 3 during a fluid droplet release according to an example of the principles described herein. FIG. 5 shows the fluid chamber (300) of FIG. 3 after some time has passed from the initiation of the drive bubble (401), and the drive bubble's (401) volume has continued to increase. At this stage, the drive bubble wall (402) extends through a chamber inlet (404) into the fluid reservoir (301). On the other side of the fluid chamber (300), the bubble wall (402) makes contact with the fluid chamber's (300) far wall (505). Another portion of the bubble wall (402) enters into the passage (308).

The drive bubble (401) may substantially isolate the fluid (306) in the passage (308) from the rest of the fluid chamber (300). As the drive bubble (401) continues to expand into the passage (308), the pressure in the passage (308) increases to such a degree that the fluid (306) in the passage (308) pushes the meniscus (307) out of the passage (308) increasing the meniscus's (307) surface area. As the meniscus (307) increases in size, a droplet (506) forms that pulls away from the passage (308).

At this stage, the drive bubble (401) continues to cover the entire surface area of the electrical impedance sensor (305). Thus, the electrical impedance sensor (305) may measure the drive bubble's (401) presence by measuring a higher resistance or impedance that the electrical impedance sensor (305) would otherwise measure if the electrical impedance sensor (305) were in contact with fluid (306).

Figure 6:
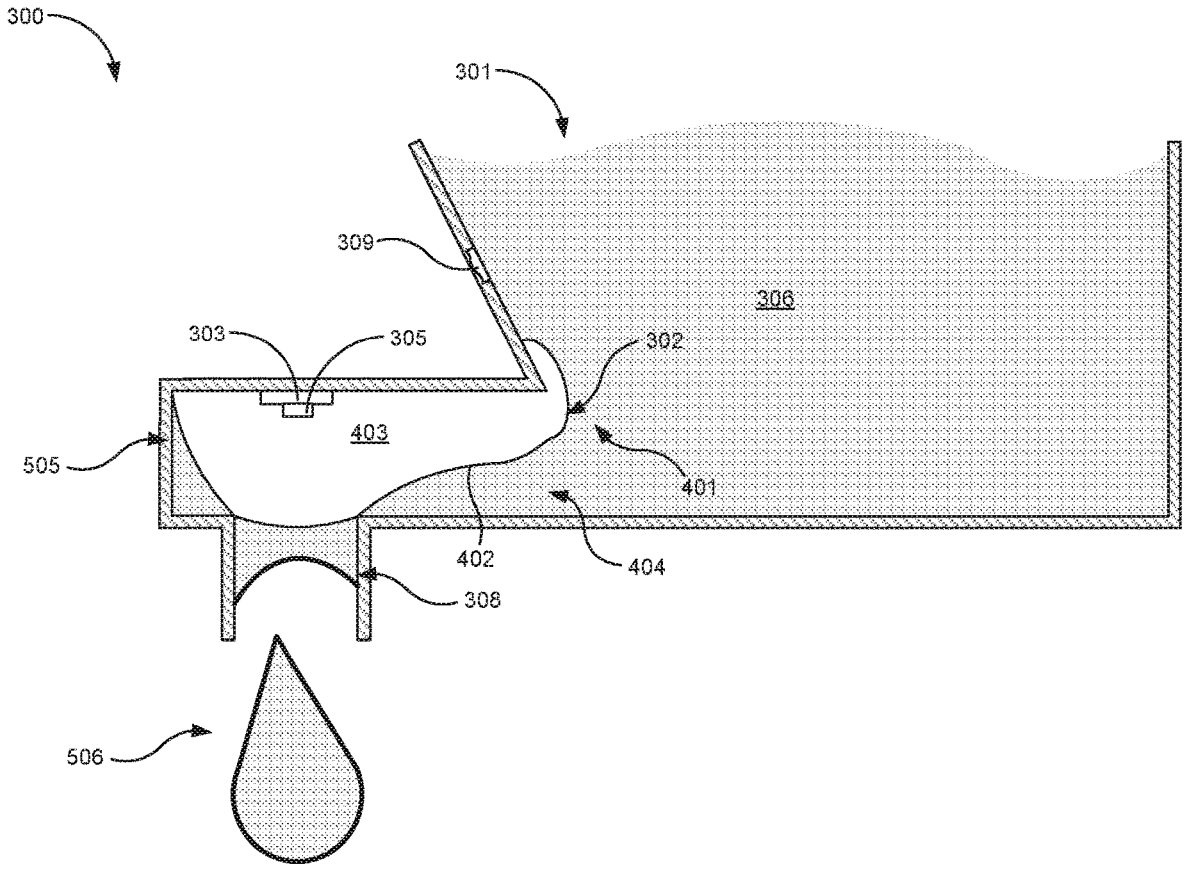
FIG. 6 is a cross-sectional diagram that depicts the fluid chamber of FIG. 3 during a fluid droplet release according to an example of the principles described herein.

FIG. 6 is a cross-sectional diagram that depicts the fluid chamber (300) of FIG. 3 during a fluid droplet release according to an example of the principles described herein. In this example, the droplet (506) is breaking free from the passage (308) and the heater (303) is deactivating. At this stage, the bubble's gas (403) cools in the absence of the heat from the heater (303). As the bubble's gas (403) cools, the drive bubble (401) shrinks, which depressurizes the fluid chamber (300). The depressurization pulls fluid (306) from the fluid reservoir (301) into the fluid chamber (300) through the inlet (302) to replenish the volume of fluid (306) lost to the droplet (506) release. Also, the meniscus (307) is pulled back into passage (308) due to the depressurization. The electrical impedance sensor (305) continues to measure a comparatively high impedance value because the drive bubble (301) continues to isolate the electrical impedance sensor (305) from the fluid (306).

Figure 7:
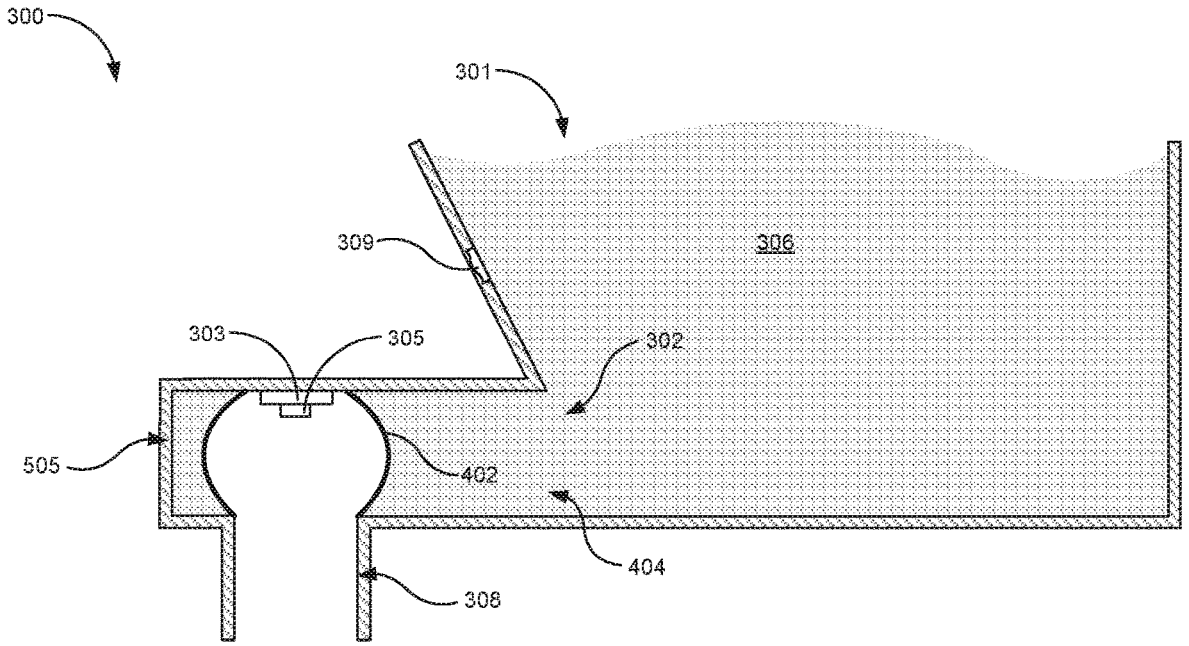
FIG. 7 is a cross-sectional diagram that depicts the fluid chamber of FIG. 3 during a fluid droplet release according to an example of the principles described herein.

FIG. 7 is a cross-sectional diagram that depict of the fluid chamber (300) of FIG. 3 during a fluid droplet release according to an example of the principles described herein. In FIG. 7, the drive bubble (401) has merged with the meniscus (307). As the internal pressure of the fluid chamber (300) increases due to the fluid flow from the fluid reservoir (301), the bubble wall (402) is forced back towards the passage (308). During this bubble wall retraction, the bubble wall (402) on the fluid reservoirs (301) side pulls away from the electrical impedance sensor (305). As the electrical impedance sensor (305) reestablishes contact with the fluid (306), the electrical impedance sensor (305) measures a lower impedance value due to the higher electrical conductivity of fluid (306).

At this stage under healthy operating conditions, the bubble wall (402) on the fluid reservoirs (301) side resists a greater amount of pressure than the bubble wall (402) on the far wall (505) due to the fluid flow from the fluid reservoir (301) reestablishing a pressure equilibrium in the fluid chamber (300). The fluid flow replenishes the lost volume of fluid (306), and the meniscus (307) moves to an end of the passage (308).

Again, FIGS. 4-7 depict an example of a fluid chamber (300) during an ink droplet release under healthy conditions. However, many conditions may adversely affect the droplet (506) release. For example, a blockage of the passage (308) may prevent the formation of a droplet (506). The electrical impedance sensor (305) measurements that result when a passage (308) is blocked may show that the drive bubble (401) forms as intended, but that the drive bubble (401) collapses more slowly than expected.

In other examples, a blockage of the fluid chamber (300) inlet (302) may prevent fluid (306) from flowing from the fluid reservoir (301) to reestablish equilibrium within the fluid chamber (300). In such a situation, the fluid (306) may fail to come back into contact with the electrical impedance sensor (305). In other cases, the fluid (306) never enters the fluid chamber (300) during a priming process.

In some examples, fluid (306) may dry and/or solidify on the heater (303) becoming a thermal barrier that inhibits the heaters (303) ability to vaporize the fluid (306). The thermal barrier may completely hinder the heaters (303) ability to form a drive bubble (401) or limit the heater (303) by forming a smaller, weaker drive bubble (401) than expected.

Also, the presence of a stray bubble may affect the droplet (506) release. Sometimes air bubbles form in either the fluid reservoir (301) or in the fluid chamber (300) itself due to air or other gasses out-gassing from the fluid (306). The mechanical compliance of a stray bubble may absorb some of the internal pressure intended to displace fluid (306) out of the passage (308) and delay the droplet (506) release. Further, a stray bubble's wall may deflect the drive bubble (401) away from the passage (308) in such a manner that the droplet (506) fails to form or forms more slowly than expected.

In some examples, an impedance measurement is taken approximately every microsecond. In some examples, at least one measurement is taken every two microseconds. At the time that a first impedance measurement is taken, the impedance value may exceed an impedance threshold value. At this threshold, the measurement signal may be converted to a "1" in binary code to indicate the presences of a drive bubble. When the first "1" is received, a processor may determine that the drive bubble is formed and record a drive bubble formation time. In an example, the drive bubble formation time is at one microsecond.

In some examples, a time lapse between the activation of the heater (303) and the formation of the drive bubble (401) may exist. For example, there may be a time lapse due to the time it takes for the heater (303) to reach a temperature sufficient to form a drive bubble (401). Also, in some examples, some fluid may solidify on the surface of the heater (303) from repeated exposure to high temperature. This solidified fluid may be a thermal barrier that inhibits the heater's (303) ability to heat the surrounding fluid (306), which may result in a slower drive bubble (401) formation time. In such an example, the drive bubble (401) formation start time may change over the life of the heater (303) and/or fluid chamber (300). This may indicate to the processor that, for example, a kogation process has occurred. As a result, a heating process may be initiated. The heating process includes draining of, at least, the area by the heater (303) and heating the heater (303) until the solidified fluid (306) is burnt away.

In some examples, after the formation of the drive bubble (401) has been detected, the impedance value may change. In this example, where the impedance value drops below a threshold value, this may indicate the absence of the drive bubble (401) and may be marked with a "0." The time duration to the formation of the drive bubble (401) and/or the time duration of the presence of the drive bubble (401) may indicating a number of other unhealthy firing conditions.

In some examples, the duration of the detection of the drive bubble (401) may indicate that bubbles had interfered with the formation of the drive bubble (401). Indeed, particles within the fluid (306) or stray bubbles may be introduced into the fluid chamber (300) that may semi-permanently reside in the fluid chamber (300). While these particles or stray bubbles may not adversely affect a droplet (506) release, they may affect the internal pressure of the fluid chamber (300) which may affect either the drive bubble (401) formation time and/or the drive bubble (401) collapse time. Each of these characteristics sensed by the electrical impedance sensor (305) during formation may be detected and determine a servicing process to be conducted.

From these examples, the impedance measurements detected by the electrical impedance sensor (305) may indicate if and which of these described unhealthy defects within the fluidic cartridge (201) are occurring. Indeed, the impedance measurements may indicate to a printing device which processes should be taken to alleviate which of the above unhealthy defects.

Figure 8:
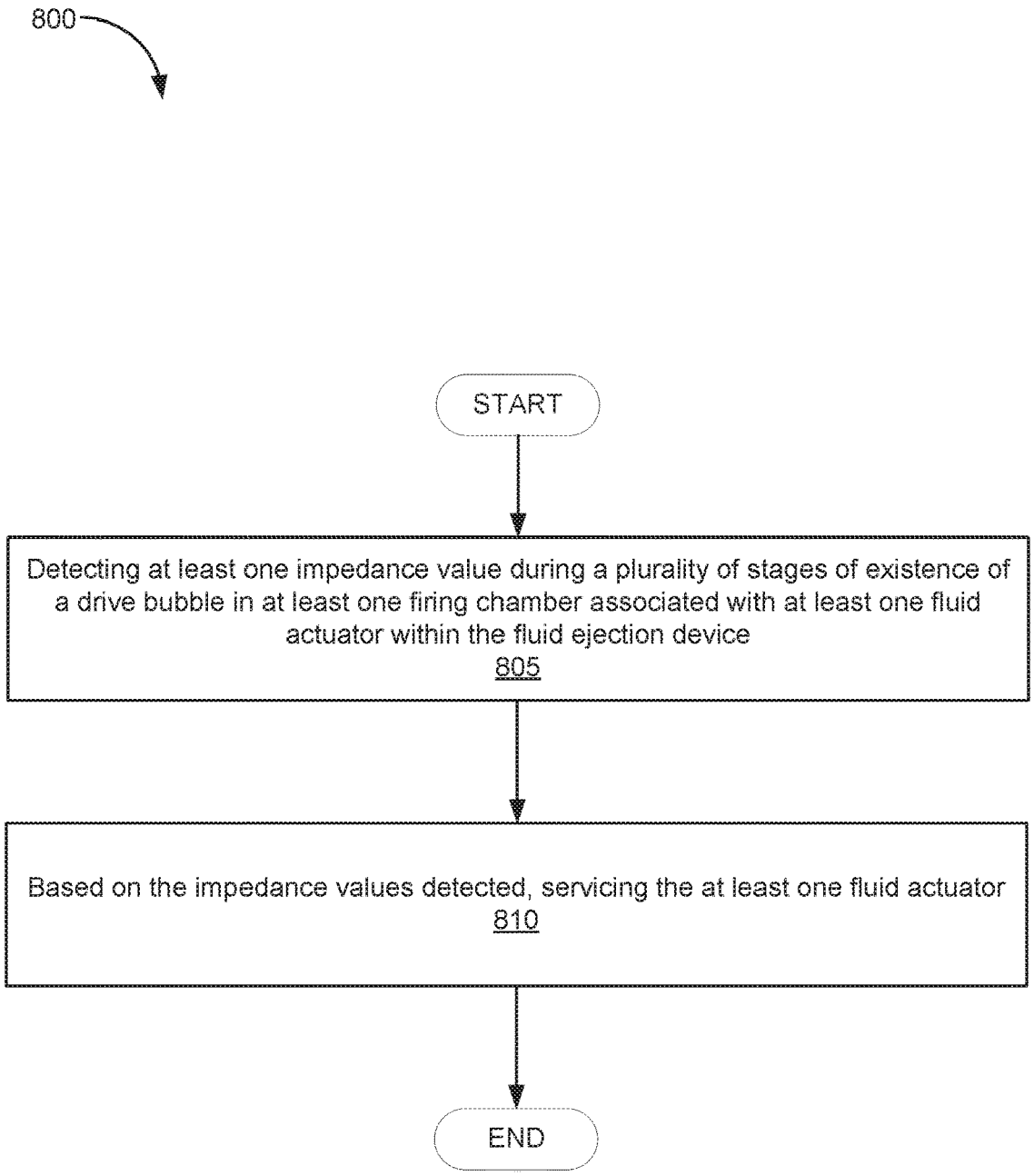
FIG. 8 is a flowchart showing a method of servicing a fluid ejection device according to an example of the principles described herein.

FIG. 8 is a flowchart showing a method (800) of servicing a fluid ejection device according to an example of the principles described herein. The method (800) may begin with detecting (805) at least one impedance value during a plurality of stages of existence of a drive bubble in at least one firing chamber associated with at least one fluid actuator within the fluid ejection device. As described herein, the impedance values may indicate which servicing is be conducted in connection with the fluid ejection device.

The method (800) may continue with, based on the impedance values detected, servicing (810) the at least one fluid actuator. As mentioned, the impedance values from the electrical impedance sensor (305) may indicate which servicing processes may be conducted.

An example of a servicing process includes a blow-out process. This blow-out process may be in response to a particle formed with the fluid chamber (300) and more specifically within the inlet (302), orifice (304), and/or passage (308). In this example, the fluidic cartridge (201) may be moved to a servicing station associated with the fluidic cartridge (201). The fluid chamber (300) may be signaled to fire as described above in connection with FIGS. 4-7. During this process, individual heaters (303) may be selectively activated in order to fire a droplet (506) out of the orifice (304). In an example, all heaters (303) may be activated in order to fire a droplet (506) out of the orifice (304).

Another example of a servicing process may include the heating process described herein. Again, the heating process may include retracting the meniscus (307) into the fluid chamber (300) thereby exposing the heater (303) to atmosphere through the orifice (304). The heater (303) may then be heated to a temperature sufficient to burn off any solidified fluid (306) on the surface of the heater (303).

Another example of a servicing process may include a wiping process. The wiping process may be conducted at the servicing station with a wiper. The wiping process may be conducted when puddling has occurred out the outer surface of the fluidic cartridge (201) by the orifices (304) and/or when particles are present on the outer surface of the fluidic cartridge (201) by the orifices (304). Additionally, the wiping process may be conducted when the impedance values have indicated that there is a blockage within the particle tolerance architecture (PTA) within the fluid chamber (300). The PTA may consist of a number of screening devices such as pillars formed within the fluid chamber (300) that strain out large particles so that they do not reach the heater (303). In some examples, this may prevent the flow of fluid into the fluid chamber (300) such that the electrical impedance sensor (305) detects the absence of fluid (306). In this case, a wiping process may be conducted to move the particle away from the PTA so that fluid may be allowed to flow into the fluid chamber (300) once again.

Another example of a servicing process may include a pumping process. In some examples, the fluid chamber (300) may include a microfluidic pump that helps to pump fluid (306) into and/or out of the fluid chamber (300). Additionally, some types of fluid (306) may include pigments that separate from the liquid vehicle component of the fluid (306). This unhealthy state of the fluid (306) is called pigment/vehicle separation (PIVS). When PIVS occurs in the fluid (306) the electrical impedance sensor (305) may detect that the impedance of the fluid (306) is not the same due to the lack of pigment within the fluid (306). The servicing process may then be initiated such that the pumps are activated in order to mix the components of the fluid (306) together again before fining of the heater (303).

In an example, the process of detecting the impedance of the fluid (306) may occur during printing or while the fluid chamber (300) is at the service station. In either example, some of the servicing processes may be conducted above a print media while others may be conducted at the service station.

Figure 9:
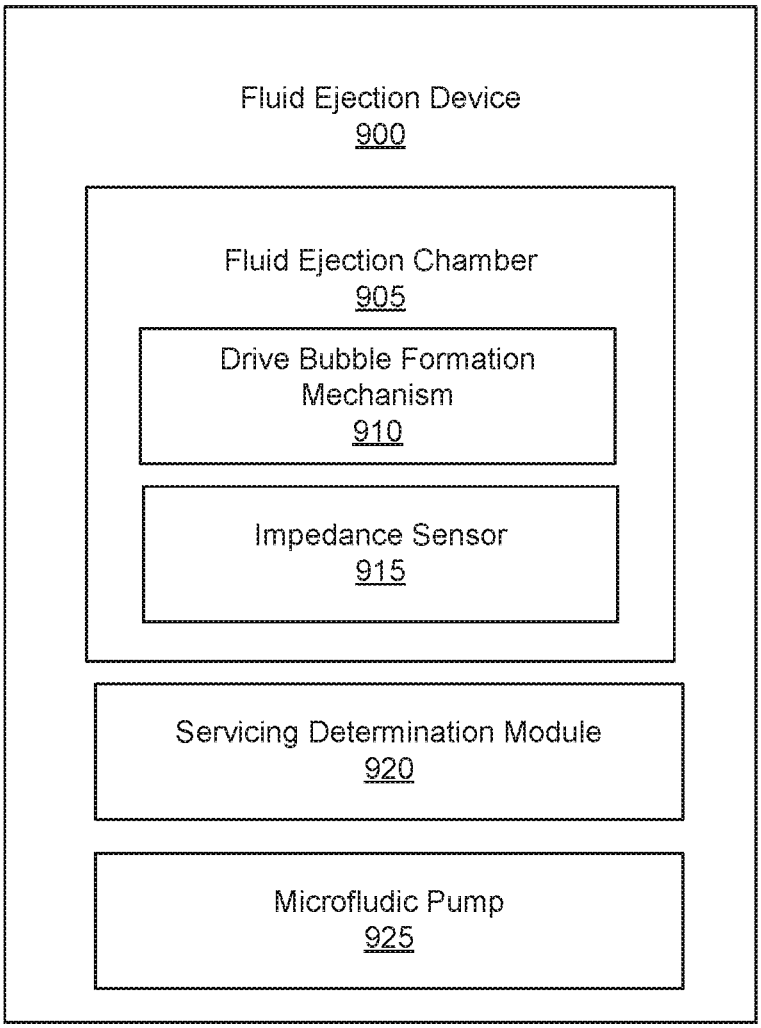
FIG. 9 is a block diagram of a fluid ejection device according to an example of the principles described herein.

FIG. 9 is a block diagram of a fluid ejection device (900) according to an example of the principles described herein. The fluid ejection device (900) may include at least one fluid ejection chamber (905). The fluid ejection chamber (905) may fluidically couple together at least one drive bubble formation mechanism (910), an electrical impedance sensor (915), a servicing determination module (920), and a microfluidic pump (925).

The fluid ejection device (900) may be any type of device that may receive a fluid such as a printing fluid and eject that fluid onto print media. Examples of a fluid ejection device (900) may include a page-wide array printing bar, a print cartridge, or other fluid ejection device. Similarly, the fluid ejection device (900) may include those material ejection devices used in an additive manufacturing device.

The fluid ejection chamber (905) may be formed within, for example, a number of thin-film layers layered on top of a silicon die. In an example, the fluid ejection chamber (905) may be a microfluidic chamber that houses the drive bubble formation mechanism (910), the electrical impedance sensor (915), and/or the microfluidic pump (925). In other examples, the electrical impedance sensor (915) and/or the microfluidic pump (925) may be formed within microfluidic channels that are fluidically coupled to the fluid ejection chamber (905).

The drive bubble formation mechanism (910) may be any device that can heat up a portion of fluid within the fluid ejection chamber (905) and form a drive bubble as described herein. In an example, the drive bubble formation mechanism (910) is a resistive heater that heats up as voltage is applied to it. The drive bubble formation mechanism (910) forms the drive bubble as described herein thereby forcing a metered amount of fluid out of an orifice.

The electrical impedance sensor (915) may be any device that can measure the impedance value at or around the location where the drive bubble formation mechanism (910) forms the drive bubble. In an example, the electrical impedance sensor (915) measures the impedance value of the fluid and/or drive bubble (absence of the fluid) any number of times during the formation of the drive bubble. These measurements, as described herein, provide information to the servicing determination module (920) to determine which service to perform on the fluid ejection device (900) and, when executed by a processor, cause the fluid ejection device (900) to be serviced accordingly. The electrical impedance sensor (915) may detect the impedance value of the fluid and/or drive bubble any of number of times a microsecond.

The servicing determination module (920) may, in some examples, receive the impedance values and determine that PIVS has occurred in the fluid. As described herein, firing of the fluid ejection device (900) under this condition may cause the fluid ejection device (900) to eject a relatively larger amount of carrier fluid within the fluid rather than a mixture of pigment and carrier fluid. This would result in a poor image quality during the printing process. The microfluidic pump (925) may then be activated by the servicing determination module (920) when this condition is detected. The microfluidic pump (925) may be formed in either the fluid ejection chamber (905) or any microfluidic channel fluidically coupled to the fluid ejection chamber (905). As the microfluidic pump (925) is activated, the pigments and carrier fluid may be recombined such that the electrical impedance sensor (915) detects a threshold level impedance value that is indicative of an appropriate mixture. Because the detection of the PIVS situation and the mixing process occur within the fluid ejection device (900), this process may be conducted above the print media or above a servicing station.

In an example, the microfluidic pump (925) may be placed in a location along a microfluidic channel that is asymmetrical along a length of the microfluidic channel. As the microfluidic pump (925) pumps the fluid through the channel, the asymmetrical placement may cause differences in pressure along the channel such that fluid moves. In an example, the microfluidic pump (925) is a heating device that causes the fluid to move when heated.

In an example, the servicing determination module (920) may also initiate a spitting process over a servicing station. This process may be done in addition to activating the microfluidic pump (925). As the pump pumps an amount of fluid and as the fluid ejection device (900) spits out the unmixed fluid from the fluid ejection chamber (905), a mixture of pigment and carrier fluid may be maintained.

Figure 10:
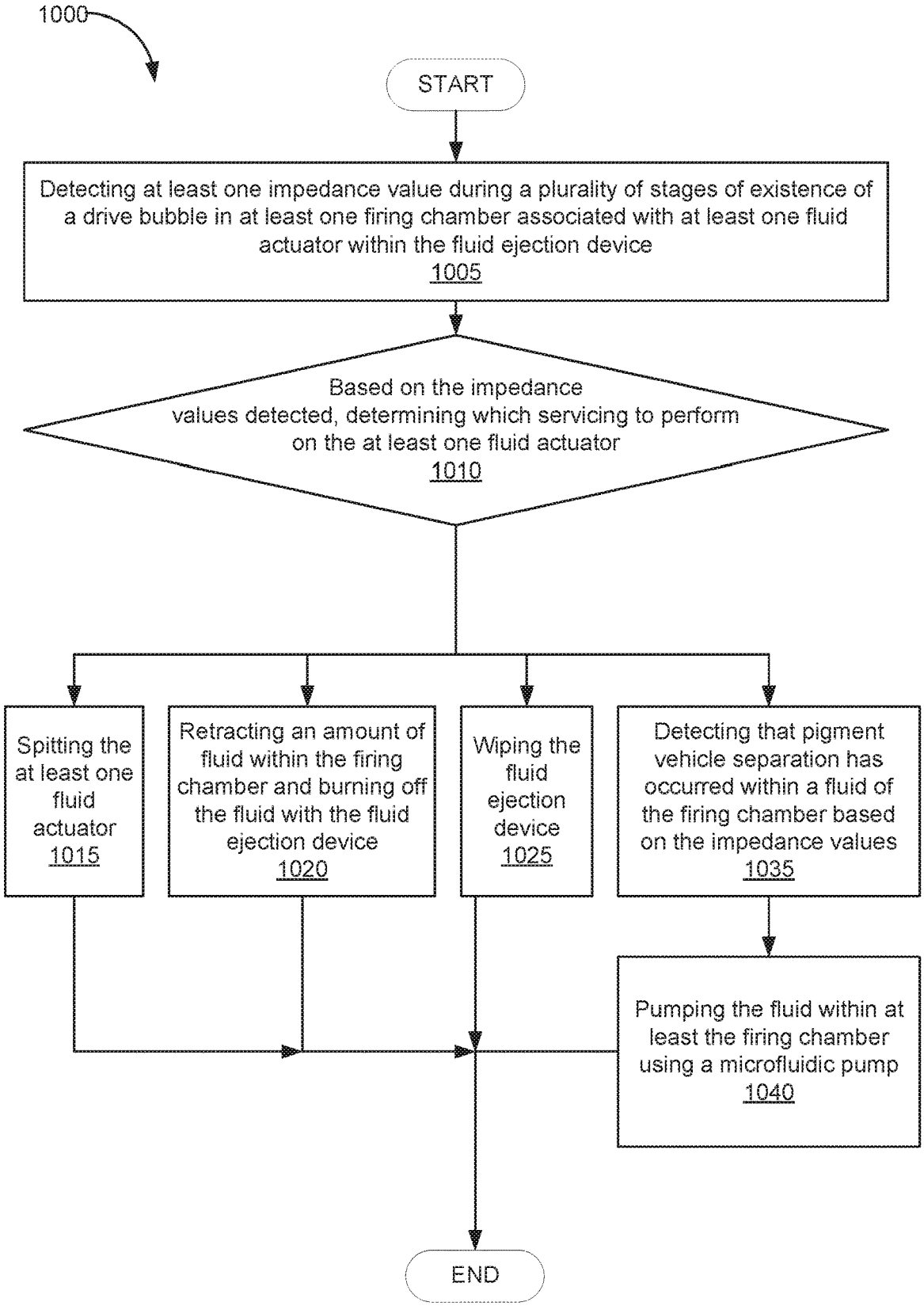
FIG. 10 is a flowchart showing a method of servicing a fluid ejection device according to an example of the principles described herein.

FIG. 10 is a flowchart showing a method (1000) of servicing a fluid ejection device according to an example of the principles described herein. The method (1000) may include detecting (1005) at least one impedance values during a plurality of stages of existence of a drive bubble in at least one firing chamber associated with at least one fluid actuator within the fluid ejection device. The method (1000) may continue with, based on the impedance values detected, determining (1010) which servicing to perform on the at least one fluid actuator. As described herein, the impedance values detected may determine which, if any, of the servicing processes may be engaged.

In an example, the method (1000) may continue with spitting (1015) the at least one fluid actuator. In an example, the method (1000) may continue with retracting (1020) an amount of fluid within the firing chamber and burning off the fluid with the fluid ejection device. In an example, the method (100) may continue with wiping (1025) the fluid ejection device. In an example, the method (1000) may continue with detecting (1035) that pigment vehicle separation has occurred within a fluid of the firing chamber based on the impedance values and pumping (1040) the fluid within at least the firing chamber using a microfluidic pump. In any of these examples, the certain servicing may be repeated.

Aspects of the present system and method are described herein with reference to flowchart illustrations and/or block diagrams of methods, apparatus (systems) and computer program products according to examples of the principles described herein. Each block of the flowchart illustrations and block diagrams, and combinations of blocks in the flowchart illustrations and block diagrams, may be implemented by computer usable program code. The computer usable program code may be provided to a processor of a general-purpose computer, special purpose computer, or other programmable data processing apparatus to produce a machine, such that the computer usable program code, when executed via, for example, the processor of the printing system (200) or other programmable data processing apparatus, implement the functions or acts specified in the flowchart and/or block diagram block or blocks. In one example, the computer usable program code may be embodied within a computer readable storage medium; the computer readable storage medium being part of the computer program product. In one example, the computer readable storage medium is a non-transitory computer readable medium.

The specification and figures describe fluid ejection device and a method of servicing the fluid ejection device. The method provides for an electrical impedance sensor to determine, based on the detected impedance values, when and which type of servicing is to be conducted on the fluid ejection device. This process allows for the detection of servicing on the fluid ejection device while the fluid ejection device is online and currently firing a fluid onto a print media. Additionally, the electrical impedance sensor (115) and its detected impedance values may indicate that at least one among a plurality of types of services should be conducted based on those impedance values detected. This provides a single device that can detect and alleviate a myriad of different types of defects within the printing system. Further, the use of the electrical impedance sensor and its detected impedance values to service the fluidic die may result in less print fluid ejected during a spitting process than would otherwise be used. Indeed, in some examples, because the electrical impedance sensor may be located within each of the fluid chambers, each individual fluid ejection device may be monitored and addressed individually by, for example, spitting an amount of fluid from the individual fluid chamber affected. Additionally, time spent wiping the fluidic die may be better spent on other types of servicing that take relatively less time to complete and that may address the true nature of the defect within the fluidic die.

The preceding description has been presented to illustrate and describe examples of the principles described. This description is not intended to be exhaustive or to limit these principles to any precise form disclosed. Many modifications and variations are possible in light of the above teaching.

What is claimed is:

1. A fluid ejection system, comprising:

a fluidic die comprising at least one fluid ejection device;

at least one electrical impedance sensor to detect at least one impedance value during a plurality of stages of existence of a drive bubble in at least one firing chamber associated with the at least one fluid ejection device; and a service station;

wherein, based on the impedance values detected, the fluid ejection system services the at least one fluid actuator by retracting an amount of fluid within the firing chamber and burning off the fluid with the fluid ejection system based on the impedance values detected.

2. The fluid ejection system of claim 1, wherein the fluid ejection system services, at the servicing station, the at least one fluid actuator by causing the at least one fluid ejection device to engage in a spitting process based on the impedance values detected.

3. The fluid ejection system of claim 1, wherein the fluid ejection system detects, based on the impedance values detected, that a pigment vehicle separation has occurred in a fluid within the firing chamber.

4. The fluid election system of claim 3, wherein the fluid ejection system pumps the fluid within the firing chamber using a microfluidic pump when pigment vehicle separation has occurred.

5. A method of servicing a fluid ejection device, comprising:

detecting at least one impedance values during a plurality of stages of existence of a drive bubble in at least one firing chamber associated with at least one fluid actuator within the fluid ejection device; and based on the impedance values detected, servicing the at least one fluid actuator by activating a microfluidic pump to, based on the impedance values, pump fluid within the at least one firing chamber.

6. The method of claim 5, wherein servicing the at least one fluid actuator comprises spitting the at least one fluid actuator.

7. The method of claim 5, wherein servicing the at least one fluid actuator comprises retracting an amount of fluid within the firing chamber and burning off the fluid with the fluid ejection device.

8. The method of claim 5, wherein servicing the at least one fluid actuator comprises wiping the fluid ejection device.

9. The method of claim 5, servicing the at least one fluid actuator comprises:

detecting that pigment vehicle separation has occurred within a fluid of the firing chamber based on the impedance values; and pumping the fluid within at least the firing chamber using the microfluidic pump.

10. The method of claim 9, wherein the microfluidic pump is placed asymmetrically along a fluid flow path within, at least, the firing chamber to cause movement of the fluid through the firing chamber.

11. The method of claim 5, wherein the detection of the at least one impedance value occurs during ejection of the fluid.

12. A fluid ejection device, comprising:

at least one fluid ejection chamber fluidically coupling together:

a drive bubble formation mechanism; and an electrical impedance sensor positioned to detect a presence of a drive bubble by executing at least one impedance measurement as the drive bubble is formed and collapses;

a servicing determination module to, when executed by a processor, service the fluid ejection chamber by activating a microfluidic pump to based, on the impedance values, pump fluid within the at least one fluid ejection chamber.

13. The fluid ejection device of claim 12, further comprising a microfluidic channel fluidically coupled to the fluid ejection chamber and wherein the microfluidic pump is placed asymmetrically within the microfluidic channel to cause the fluid to be pumped through the microfluidic channel and fluid ejection chamber.

14. The fluid ejection device of claim 12, wherein the servicing determination module further initiates a spitting process to eject an amount of fluid from the fluid ejection chamber based on the plurality of impedance measurements.

* * * * *